US012523057B2

(12) United States Patent
Zhang et al.

(10) Patent No.: US 12,523,057 B2
(45) Date of Patent: Jan. 13, 2026

(54) POLE YURT FRAMING STRUCTURE SYSTEM AND CONSTRUCTION METHOD THEREOF

(71) Applicants: Inner Mongolia University of Technology, Inner Mongolia (CN); Inner Mongolian Grand Architecture Design CO., LTD., Inner Mongolia (CN)

(72) Inventors: Pengju Zhang, Inner Mongolia (CN); Lagenbaier Zha, Inner Mongolia (CN); Long He, Inner Mongolia (CN); Guoqiang Xu, Inner Mongolia (CN); Liyan Bai, Inner Mongolia (CN)

( * ) Notice: Subject to any disclaimer, the term of this patent is extended or adjusted under 35 U.S.C. 154(b) by 318 days.

(21) Appl. No.: 18/378,601

(22) Filed: Oct. 10, 2023

(65) Prior Publication Data

US 2024/0035299 A1 Feb. 1, 2024

(30) Foreign Application Priority Data

Dec. 16, 2022 (CN) ..... 202211623178.2

(51) Int. Cl.
*E04H 15/00* (2006.01)
*E04H 15/34* (2006.01)

(52) U.S. Cl.
CPC ..... *E04H 15/008* (2013.01); *E04H 15/34* (2013.01)

(58) Field of Classification Search
CPC ..... E04H 15/008; E04H 15/34; E04H 15/18; E04H 1/1205; E04H 2001/3294
See application file for complete search history.

(56) References Cited

U.S. PATENT DOCUMENTS 1,806,354 A * 5/1931 Lange ..... E04B 1/10 52/282.4
3,118,186 A * 1/1964 Moss ..... E04H 15/008 52/80.1
3,277,620 A * 10/1966 Martin ..... E04B 1/34321 52/270
3,683,427 A * 8/1972 Burkholz ..... E04H 4/108 52/80.1
4,263,758 A * 4/1981 Seaich ..... E04B 1/3211 D25/13
4,784,172 A * 11/1988 Yacoboni ..... E04H 1/1205 135/904

(Continued)

*Primary Examiner* — Noah Chandler Hawk

(57) ABSTRACT

A pole yurt framing structure system includes: a crown wheel, a roof pole, and a lattice wall; wherein the crown wheel is a prismatic conical structure formed by multiple triangular first pole orthogonally stacked wooden rib structures; the roof pole includes multiple rectangular second pole orthogonally stacked wooden rib structures and multiple triangular third pole orthogonally stacked wooden rib structures; and the lattice wall includes at least one cuboid frame and multiple rectangular frames. A construction method of the pole yurt framing structure system uses assembly technology. The composite wooden poles with the same specifications are prefabricated by the factory, which are assembled on site to form the pole orthogonally stacked wooden rib structures. Finally, the pole yurt framing can be obtained. The technical scheme reduces the production and design cost, and reduces environment pollution caused by the construction.

19 Claims, 6 Drawing Sheets

(56) References Cited

U.S. PATENT DOCUMENTS

| | | | | |
|---|---|---|---|---|
| 5,377,460 | A * | 1/1995 | Hicks | E04B 7/10 52/80.1 |
| D397,445 | S * | 8/1998 | Thorbeck | D25/1 |
| 8,429,858 | B1 * | 4/2013 | Robinson | E04H 1/005 52/63 |
| 10,753,078 | B2 * | 8/2020 | Fedorov | E04H 15/36 |
| 2016/0017620 | A1 * | 1/2016 | Connors | E04H 15/54 135/96 |
| 2019/0309507 | A1 * | 10/2019 | Fedorov | E04H 15/18 |

* cited by examiner

POLE YURT FRAMING STRUCTURE SYSTEM AND CONSTRUCTION METHOD THEREOF

CROSS REFERENCE OF RELATED APPLICATION

The present invention claims priority under 35 U.S.C. 119(a-d) to CN 202211623178.2, filed Dec. 16, 2022.

BACKGROUND OF THE PRESENT INVENTION

Field of Invention

The present invention relates to yurt construction, and more particularly to a pole yurt framing structure and a construction method thereof.

Description of Related Arts

The complexity of the materials needed to build traditional yurts and the poor weather resistance of their structures make the traditional yurts difficult to adapt to the needs of modern herders' life. As a result, traditional yurts are gradually replaced by various conventional masonry construction forms, and brick and tile houses are widely used by herders as their dwellings. This change reflects the contradiction between the use of new materials and technologies and the use of traditional construction methods. However, the masonry structure has lost the local characteristics and is not good for spreading and passing down Mongolian culture. In addition, the masonry structure is heavy and can't be stored and moved like traditional yurts. Conventional wooden yurt structure is mainly divided into heavy wooden structure and light wooden structure, but even the light wooden structure is still too big for the small-sized building on the grassland, and it needs large equipment for construction, which increases the construction cost for the herders and destroys the ecological environment of the grassland. Furthermore, coarse wood with large diameter is widely used in the conventional wooden structure, leading to high material consumption up to 0.04 $m^3$ of wood per square meter. Therefore, there is a need to build lightweight yurts that fit the grassland environment.

SUMMARY OF THE PRESENT INVENTION

In order to solve the above problems, a first object of the present invention is to provide a pole yurt framing structural system which is structurally stable, lightweight, easy to assemble, ecologically friendly, low in wood usage, and low in cost.

A second object of the present invention is to provide a construction method of the pole yurt framing structural system that is structurally stable, lightweight, easy to assemble, ecologically friendly, low in wood usage, and low in cost.

Accordingly, in order to accomplish the first object, the present invention provides:

a pole yurt framing structure system, comprising: a crown wheel, a roof pole, and a lattice wall; wherein the crown wheel is a prismatic conical structure formed by multiple triangular first pole orthogonally stacked wooden rib structures; each side of the first pole orthogonally stacked wooden rib structures is fixed with a side of an adjacent first pole orthogonally stacked wooden rib structure;

the roof pole comprises multiple rectangular second pole orthogonally stacked wooden rib structures and multiple triangular third pole orthogonally stacked wooden rib structures; wherein quantities of the second pole orthogonally stacked wooden rib structures, the third pole orthogonally stacked wooden rib structures, and the first pole orthogonally stacked wooden rib structures are identical; a top portion of each of the second pole orthogonally stacked wooden rib structures is fixed with a bottom portion of a corresponding first pole orthogonally stacked wooden rib structure by a first connector; two adjacent second pole orthogonally stacked wooden rib structures are spaced by one of the third pole orthogonally stacked wooden rib structures, and each side of the third pole orthogonally stacked wooden rib structures is fixed with a side of an adjacent second pole orthogonally stacked wooden rib structure;

the lattice wall comprises at least one cuboid frame and multiple rectangular frames; wherein a total quantity of the cuboid frame and the rectangular frames is equal to a total quantity of the second pole orthogonally stacked wooden rib structures and the third pole orthogonally stacked wooden rib structures; an internal top portion of the cuboid frame is fixed with bottom portions of the second pole orthogonally stacked wooden rib structures or bottom portions of the third pole orthogonally stacked wooden rib structures by a second connector; two sides of the cuboid frame are provided with the rectangular frames, and the rectangular frames are fixed with an adjacent internal side of the cuboid frame; the rest of the rectangular frames are fixed with adjacent rectangular frames in sequence; top portions of the rectangular frames are fixed with the bottom portions of the second pole orthogonally stacked wooden rib structures or the bottom portions of the third pole orthogonally stacked wooden rib structures by the second connector.

Preferably, the first pole orthogonal stacked wooden rib structures comprise at least two layers of composite wooden pole units, and each layer of the composite wooden pole units comprises multiple composite wooden poles disposed in parallel; the composite wooden poles of one layer of the composite wooden pole units are perpendicular to the composite wooden poles of an adjacent layer of the composite wooden pole units; when the first pole orthogonally stacked wooden rib structures comprise three or more layers of the composite wooden pole units, the composite wooden poles of odd-numbered layers correspond to each other from top to bottom and the composite wooden poles of even-numbered layers correspond to each other from top to bottom; the composite wooden poles are fixed with each other at cross nodes by third connectors; the composite wooden pole units of the odd-numbered layers are provided with a triangular frame, and the triangular frame comprises three frame composite wooden poles joined end to end; ends of the composite wooden poles of the composite wooden pole units of the odd-numbered layers are all in contact with an internal wall of the triangular frame of a corresponding layer; ends of the composite wooden poles of the composite wooden pole units of the even-numbered layer are all flush with an external wall of the triangular frame; the triangular frame of the odd-numbered layers is fixed with the composite wooden poles of the even-numbered layers at cross nodes by the third connectors.

Preferably, the second pole orthogonal stacked wooden rib structures comprise at least two layers of composite wooden pole units, and each layer of the composite wooden pole units comprises multiple composite wooden poles disposed in parallel; the composite wooden poles of one layer of the composite wooden pole units are perpendicular to the composite wooden poles of an adjacent layer of the composite wooden pole units; when the second pole orthogonally stacked wooden rib structures comprise three or more layers of the composite wooden pole units, the composite wooden poles of odd-numbered layers correspond to each other from top to bottom and the composite wooden poles of even-numbered layers correspond to each other from top to bottom; the composite wooden poles are fixed with each other at cross nodes by third connectors; the composite wooden pole units of the odd-numbered layers are provided with a rectangular frame, and the rectangular frame comprises four frame composite wooden poles joined end to end; ends of the composite wooden poles of the composite wooden pole units of the odd-numbered layers are all in contact with an internal wall of the rectangular frame of a corresponding layer; ends of the composite wooden poles of the composite wooden pole units of the even-numbered layer are all flush with an external wall of the rectangular frame; the rectangular frame of the odd-numbered layers is fixed with the composite wooden poles of the even-numbered layers at cross nodes by the third connectors.

Preferably, the third pole orthogonal stacked wooden rib structures comprise at least two layers of composite wooden pole units, and each layer of the composite wooden pole units comprises multiple composite wooden poles disposed in parallel; the composite wooden poles of one layer of the composite wooden pole units are perpendicular to the composite wooden poles of an adjacent layer of the composite wooden pole units; when the third pole orthogonally stacked wooden rib structures comprise three or more layers of the composite wooden pole units, the composite wooden poles of odd-numbered layers correspond to each other from top to bottom and the composite wooden poles of even-numbered layers correspond to each other from top to bottom; the composite wooden poles are fixed with each other at cross nodes by third connectors; the composite wooden pole units of the odd-numbered layers are provided with a triangular frame, and the triangular frame comprises three frame composite wooden poles joined end to end; ends of the composite wooden poles of the composite wooden pole units of the odd-numbered layers are all in contact with an internal wall of the triangular frame of a corresponding layer; ends of the composite wooden poles of the composite wooden pole units of the even-numbered layer are all flush with an external wall of the triangular frame; the triangular frame of the odd-numbered layers is fixed with the composite wooden poles of the even-numbered layers at cross nodes by the third connectors.

Preferably, each side frame of the cuboid frame comprises multiple composite wooden poles, and the composite wooden poles are integrated by parallel stacking.

Preferably, each side frame of the rectangle frames comprises multiple composite wooden poles, and the composite wooden poles are integrated by parallel stacking.

Preferably, each of the composite wooden poles comprises at least two layers of wooden boards, and adjacent layers of the wooden boards are bonded and fixed to each other. The composite wooden pole is formed by bonding and fixing multiple layers of wooden boards, which is cheaper than lumber poles lower cost. The composite wooden pole is not easy to break, and load bearing capacity thereof is stronger.

Preferably, the wooden boards of the composite wooden poles of a bottom layer of the composite wooden pole units of the first pole orthogonally stacked wooden rib structures are arranged vertically; the wooden boards of the composite wooden poles of a bottom layer of the composite wooden pole units of the second pole orthogonally stacked wooden rib structures are arranged vertically; and the wooden boards of the composite wooden poles of a bottom layer of the composite wooden pole units of the third pole orthogonally stacked wooden rib structures are arranged vertically. Since deflection of the composite wooden pole units of a top layer of the pole orthogonally stacked wooden rib structure is small and the deflection gets larger from top to bottom, the composite wooden poles of a bottom layer of the composite wooden pole units of the pole orthogonally stacked wooden rib structures are arranged vertically to counteract part of the force, so as to preventing structural damage.

Preferably, each of the composite wooden poles has a square cross-section. When the composite wooden pole is placed horizontally and subjected to a vertical force, the square cross-section thereof has a better load-bearing capacity than a rectangular one. When the composite wooden pole is placed vertically, the square cross-section thereof has a better capacity than the rectangular one to resist a lateral external force. Thus, the composite wooden pole is prefabricated to have the square cross-section. Furthermore, the composite wooden pole with the square cross-section facilitates subsequent assembly.

Preferably, each of the third connectors comprises a nut, a spacer, an upper steel sheet, a lower steel sheet and a screw; wherein through holes are drilled on the upper steel sheet, the lower steel sheet, and cross nodes of the orthogonally stacked composite wooden poles, which are adapted to the diameter of the screw; the screw passes through the spacer, the upper steel sheet, the orthogonally stacked composite wooden poles, and the lower steel sheet from top to bottom; a portion of the screw, which is above the spacer, is screwed with the nut, and the nut presses against the spacer; a bottom end of the screw is welded to the lower steel sheet, and the lower steel sheet presses against an adjacent composite wooden pole. During assembling the first pole orthogonally stacked wooden rib structures, the second pole orthogonally stacked wooden rib structures or the third pole orthogonally stacked wooden rib structures, if nuts are connected to both ends of the screw, then the nut below the lower steel sheet can be seen in the indoor space, which affects indoor aesthetics. if both ends of the screw are welded, due to difference in materials between the screw, the spacer and the lower steel sheet, the welding points will be weak and the welding may not be perpendicular, leading to damage of the third connector and weak connection. Therefore, the portion of the screw, which is above the spacer, is screwed with the nut; and the bottom end of the screw is welded to the lower steel sheet. In addition, the screw is too long, and when protruding from the nut or the lower steel sheet after installation, the screw is easy to cause damage to other enclosing materials mounted on the pole yurt framing, affecting the integrity of the building. Therefore, after connecting and fixing the composite wooden poles by the third connectors, excess portions of the screw should be processed and cut off according to actual needs.

Preferably, the first connector is a V-shaped steel; internal top edges of the second pole orthogonally stacked wooden rib structures press against corresponding internal bottom edges of the first pole orthogonally stacked wooden rib structure; a space, which has a triangular cross-section, is formed by the top portion of each of the second pole orthogonally stacked wooden rib structures and the bottom portion of the corresponding first pole orthogonally stacked wooden rib structure, and the V-shaped steel is placed in the space; one side of the V-shaped steel matches with the top portions of the second pole orthogonally stacked wooden rib structures and is bolted thereto; the other side of the V-shaped steel matches with the bottom portion of the corresponding first pole orthogonally stacked wooden rib structure and is bolted thereto.

Preferably, the second connector is a steel angle; an internal edge of the internal top portion of the cuboid frame presses against internal edges of the bottom portions of the second pole orthogonally stacked wooden rib structures, or against internal edges of the bottom portions of the third pole orthogonally stacked wooden rib structures; a space is formed between the internal top portion of the cuboid frame and the bottom portions of the second pole orthogonally stacked wooden rib structures or the bottom portions of the third pole orthogonally stacked wooden rib structures, and the steel angle is placed in the space; one side of the steel angle matches with the internal top portion of the cuboid frame and is bolted thereto; the other side of the steel angle presses against external edges of the bottom portions of the second pole orthogonally stacked wooden rib structures, or against external edges of the bottom portions of the third pole orthogonally stacked wooden rib structures;

internal edges of the top portions of the rectangular frames press against the internal edges of the bottom portions of the second pole orthogonally stacked wooden rib structures, or against internal edges of the bottom portions of the third pole orthogonally stacked wooden rib structures; a space is formed between the top portions of the rectangular frames and the bottom portions of the second pole orthogonally stacked wooden rib structures or the bottom portions of the third pole orthogonally stacked wooden rib structures, and the steel angle is placed in the space; one side of the steel angle matches with the top portions of the rectangular frames and is bolted thereto; the other side of the steel angle presses against the external edges of the bottom portions of the second pole orthogonally stacked wooden rib structures, or against the external edges of the bottom portions of the third pole orthogonally stacked wooden rib structures.

Accordingly, in order to accomplish the second object, the present invention provides:

a construction method of the pole yurt framing structure system, comprising steps of: (1) prefabricating composite wooden poles; (2) assembling unit structures; (3) assembling the lattice wall; (4) installing the roof pole; and (5) installing the crown wheel; wherein.

the step (1) comprises specific steps of: prefabricating the composite wooden poles in a factory by gluing at least two layers of wooden boards together to form one composite wooden pole;

the step (2) comprises specific steps of: assembling the first pole orthogonal stacked wooden rib structures, the second pole orthogonal stacked wooden rib structures, the third pole orthogonal stacked wooden rib structures, the cuboid frame, and the rectangular frames at a construction site with the prefabricated composite wooden poles;

the step (3) comprises specific steps of: assembling the lattice wall with the cuboid frame and the rectangular frames obtained in the step (2);

the step (4) comprises specific steps of: installing the second pole orthogonal stacked wooden rib structures and the third pole orthogonal stacked wooden rib structures obtained in the step (2) on a top of the lattice wall obtained in step (3) to complete roof pole assembly; and the step (5) comprises specific steps of: installing the first pole orthogonally stacked wooden rib structures obtained in the step (2) on a top of the roof pole obtained in the step (4) to complete crown wheel assembly, thereby finishing the pole yurt framing structure system.

Advantages of the Present Invention

1. The present invention provides a pole yurt framing structure system and a construction method thereof, using assembly technology. The composite wooden poles with the same specifications are prefabricated by the factory, which are assembled on site to form the pole orthogonally stacked wooden rib structures. Combination forms and stacking numbers of the composite wooden poles can be adjusted according to the span design, so as to be flexibly combined to meet the specific needs. Finally, the pole yurt framing can be obtained. Compared to the wooden structure with the same loading capacity, the pole orthogonally stacked wooden rib structure provided by the present invention consumes 0.02 $m^3$ of wood per square meter, which saves about 50% of wood, reduces the production and design cost, saves time and labor, needs no large equipment for construction, reduces the destruction of the grassland, saves energy and emission, and reduces environment pollution caused by the construction. The main material is wood, which has a light weight, renewable, recyclable, and eco-friendly.
2. The composite wooden poles are fixed by connectors instead of the traditional bundling method, so that the pole orthogonal stacked wooden rib structure is more stable and has a high loading capacity. The structure also has a certain degree of flexibility, so that the parts can be adjusted and replaced according to the needs of daily use. The overall structural strength is stable and the form of the structure is beautiful, in such a manner that a large span of column-free space is provided, and the interior space is more exquisite.

BRIEF DESCRIPTION OF THE DRAWINGS

In order to more clearly illustrate the technical solutions in embodiments or prior art of the present invention, the accompanying drawings will be briefly introduced below. It is obvious that the accompanying drawings in the following description only illustrates some of the embodiments of the present invention, and other drawings can be obtained by a person of ordinary skill in the are according to the accompanying drawings without making any creative labor.

ELEMENT REFERENCE

1—crown wheels; 11—first pole orthogonally stacked wooden rib structure; 2—roof pole; 21—second pole orthogonally stacked wooden rib structure; 22—third pole orthogonally stacked wooden rib structure; 3—lattice wall; 31—cuboid frame; 32—rectangular frame; 4—first connector; 5—second connector; 6—composite wooden pole; 61—wooden board; 7—third connector; 71—nut; 72—spacer; 73—upper steel sheet; 74—lower steel sheet; 75—screw; 8—bolt.

DETAILED DESCRIPTION OF THE PREFERRED EMBODIMENT

In order to show the technical solutions, purposes and advantages more concisely and clearly, the present invention will be further illustrated in conjunction with the following embodiments. Obviously, the described embodiments are only part of all embodiments of the present invention. Based on the described embodiments of the present invention, all other embodiments obtained by the person of ordinary skill in the art without creative labor are within the protection scope of the present invention.

Embodiment 1

Figure 1:
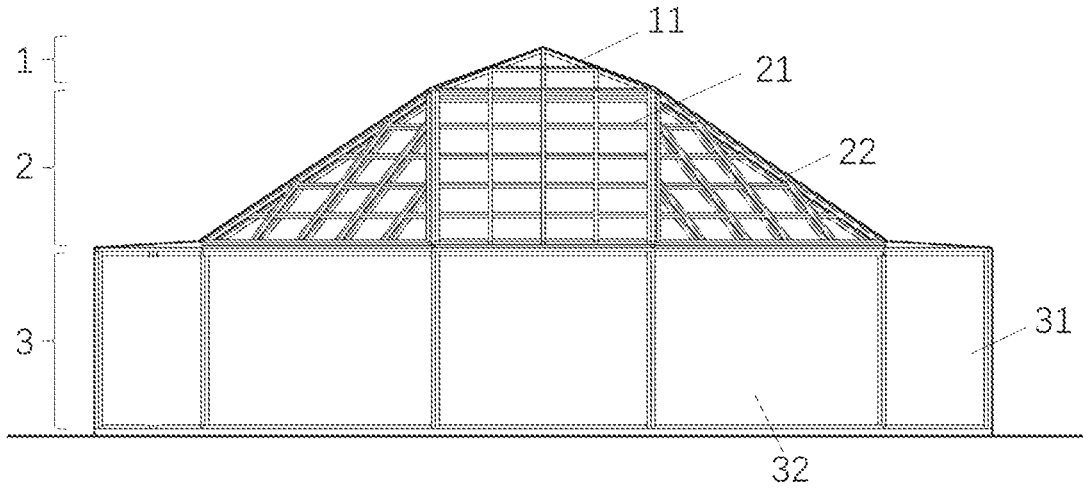
FIG. 1 is a sketch of a pole yurt framing structure system.
Figure 2:
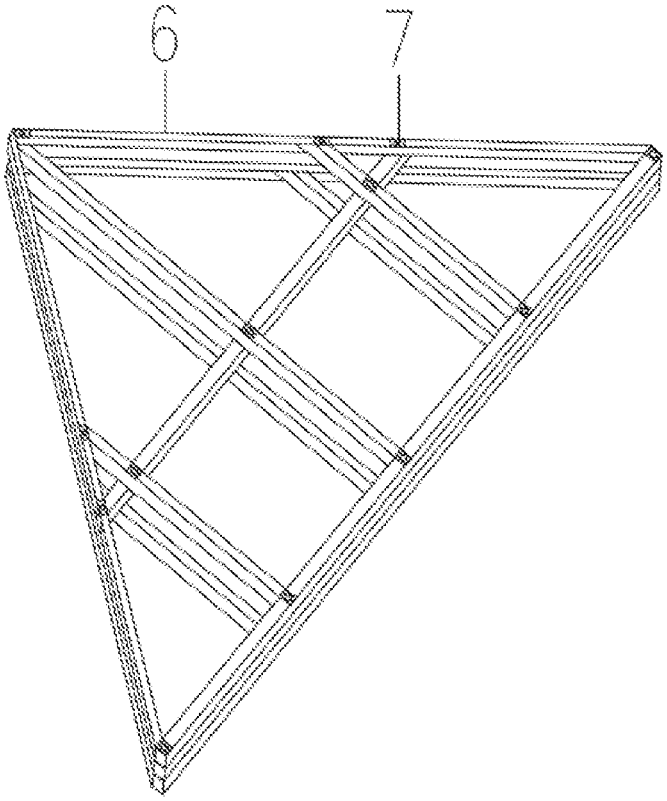
FIG. 2 is a perspective view of a first pole orthogonally stacked wooden rib structure.
Figure 3:
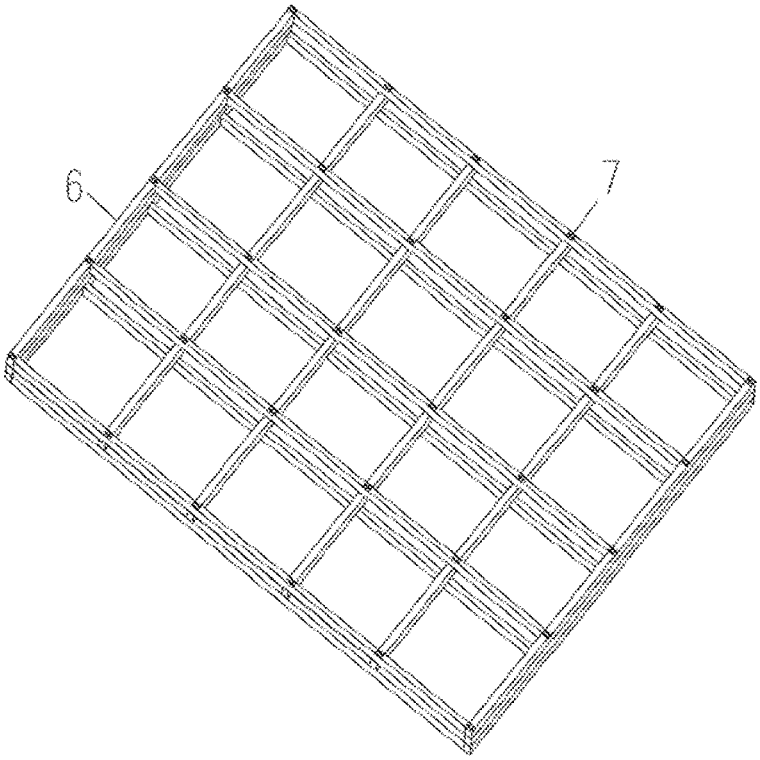
FIG. 3 is a perspective view of a second pole orthogonal stacked wooden rib structure.
Figure 4:
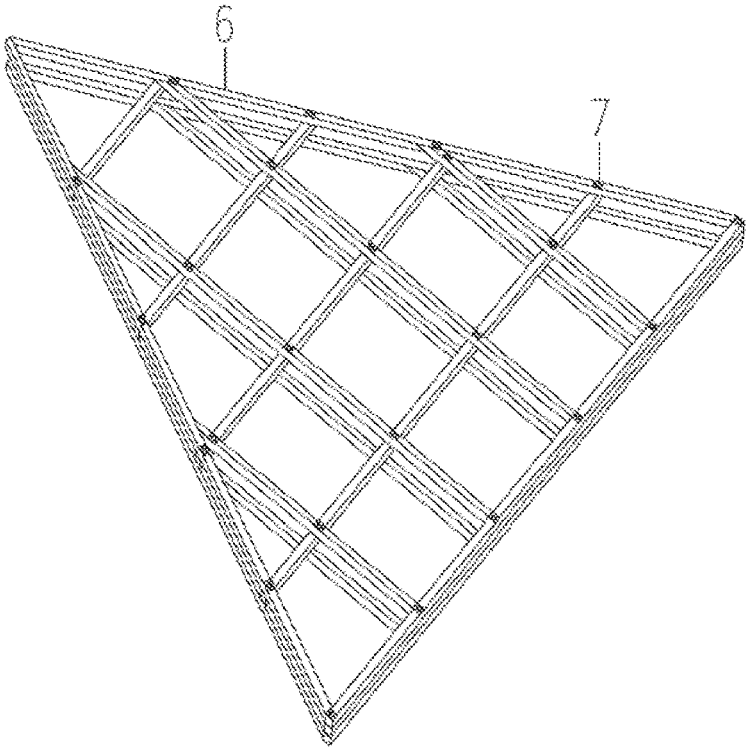
FIG. 4 is a perspective view of a third pole orthogonal stacked wooden rib structure.
Figure 5:
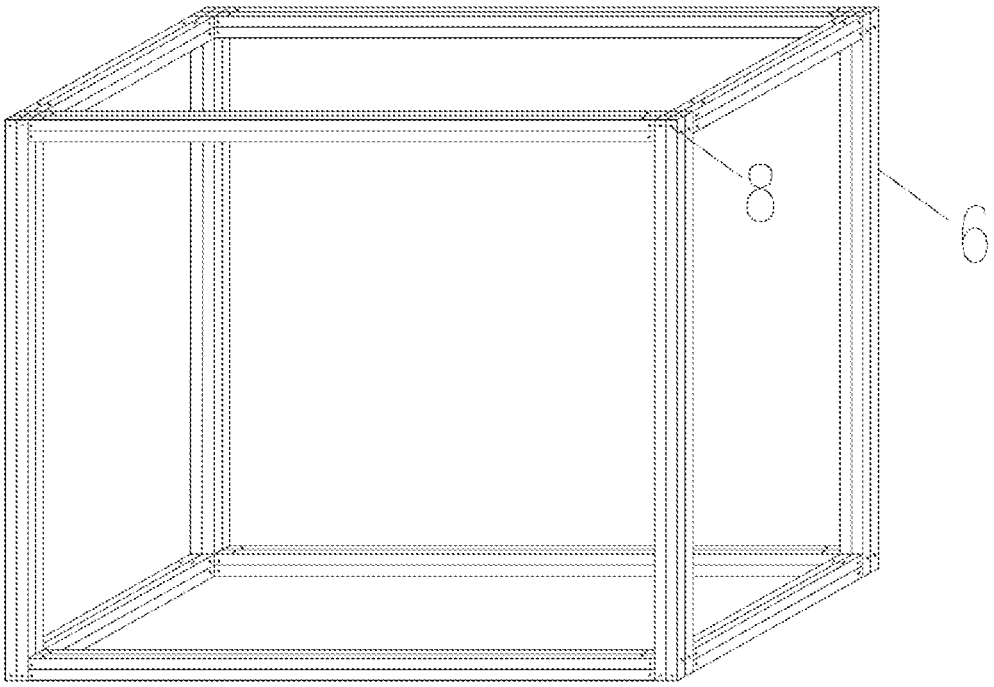
FIG. 5 is a perspective view of a cuboid frame.
Figure 6:
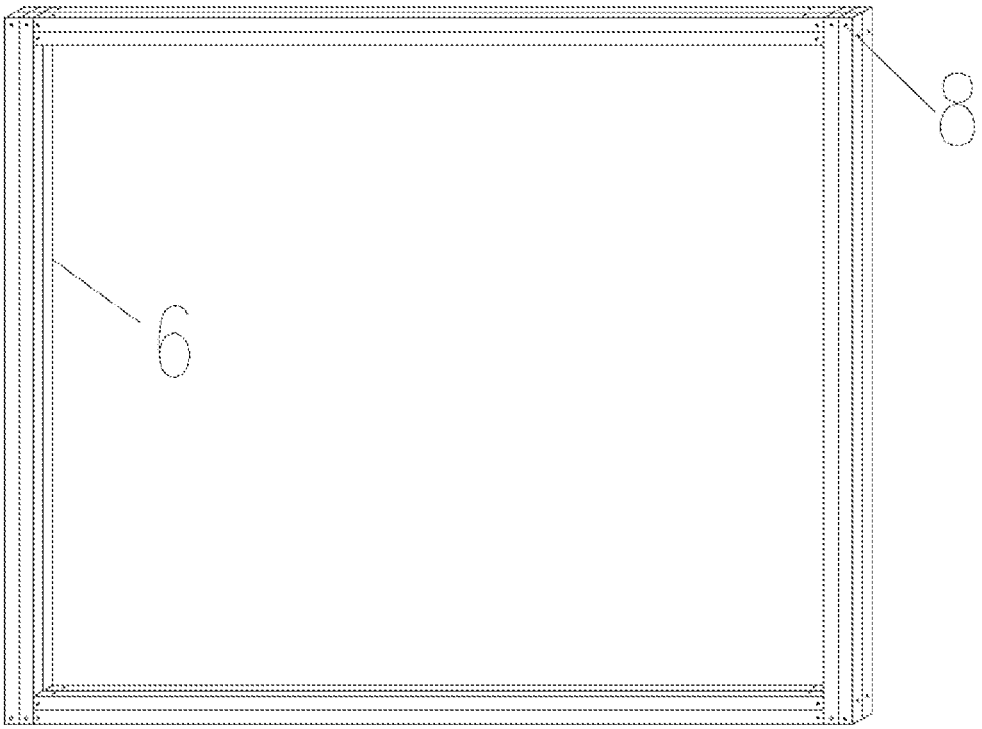
FIG. 6 is a sketch view of a rectangular frame.
Figure 7:
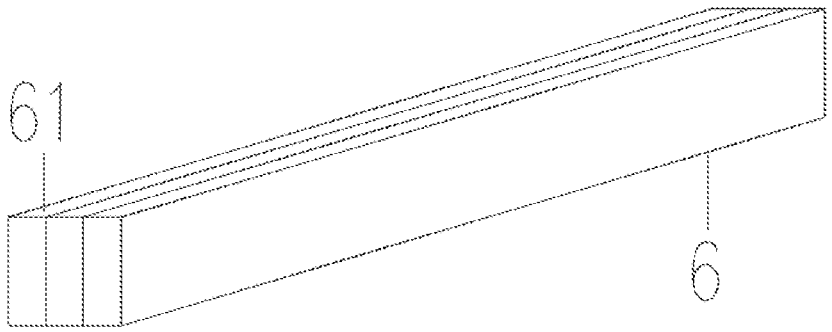
FIG. 7 is a perspective view of a composite wooden pole with vertically arranged wooden boards.
Figure 8:
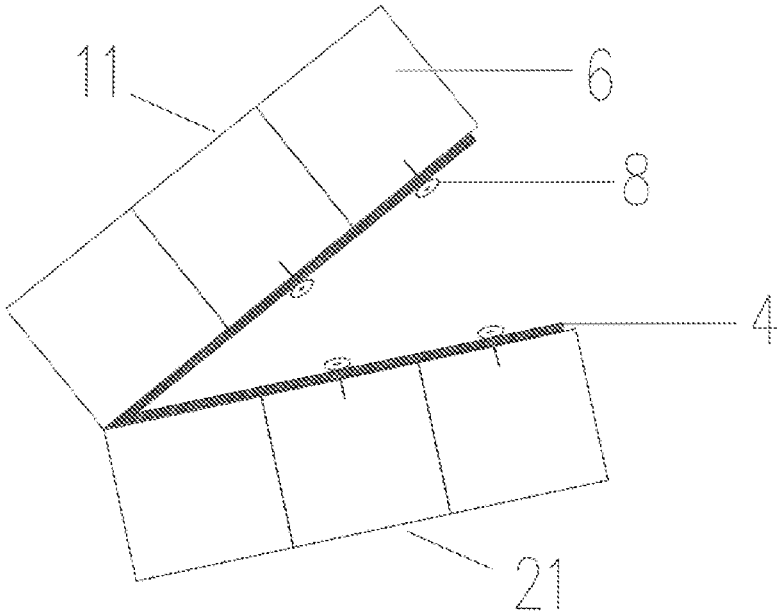
FIG. 8 is a sketch view of a first connector.

A pole yurt framing structure system is shown in FIG. 1, comprising: a crown wheel 1, a roof pole 2, and a lattice wall 3; wherein the crown wheel 1 is a prismatic conical structure formed by four triangular first pole orthogonally stacked wooden rib structures 11; each side of the first pole orthogonally stacked wooden rib structures 11 is fixed with a side of an adjacent first pole orthogonally stacked wooden rib structure 11;

the roof pole 2 comprises four rectangular second pole orthogonally stacked wooden rib structures 21 and four triangular third pole orthogonally stacked wooden rib structures 22; wherein a top portion of each of the second pole orthogonally stacked wooden rib structures 21 is fixed with a bottom portion of a corresponding first pole orthogonally stacked wooden rib structure 11 by a first connector 4; two adjacent second pole orthogonally stacked wooden rib structures 21 are spaced by one of the third pole orthogonally stacked wooden rib structures 22, and each side of the third pole orthogonally stacked wooden rib structures 22 is fixed with a side of an adjacent second pole orthogonally stacked wooden rib structure 21;

the lattice wall 3 comprises four cuboid frames 31 and four rectangular frames 32; wherein an internal top portion of the cuboid frame 31 is fixed with bottom portions of the second pole orthogonally stacked wooden rib structures 21 by a second connector 5; two sides of the cuboid frame 31 are provided with the rectangular frames 32, and the rectangular frames 32 are fixed with an adjacent internal side of the cuboid frame 31 by a bolt; top portions of the rectangular frames 32 are fixed with the bottom portions of the third pole orthogonally stacked wooden rib structures 22 by the second connector 5 doors or windows are arranged in the cuboid frames 31.

The first pole orthogonal stacked wooden rib structures 11 comprise three layers of composite wooden pole units, wherein odd-numbered layer of the composite wooden pole units comprises three composite wooden poles 6 disposed in parallel, and even-numbered layer of the composite wooden pole units comprises two composite wooden poles 6 disposed in parallel; a size of the composite wooden poles 6 is 45×45×4000 mm; the composite wooden poles 6 of one layer of the composite wooden pole units are perpendicular to the composite wooden poles 6 of an adjacent layer of the composite wooden pole units; the composite wooden poles 6 of odd-numbered layers correspond to each other from top to bottom; the composite wooden poles 6 are fixed with each other at cross nodes by third connectors 7; the composite wooden pole units of the odd-numbered layers are provided with a triangular frame, and the triangular frame comprises three frame composite wooden poles 6 joined end to end; ends of the composite wooden poles 6 of the composite wooden pole units of the odd-numbered layers are all in contact with an internal wall of the triangular frame of a corresponding layer; ends of the composite wooden poles 6 of the composite wooden pole units of the even-numbered layer are all flush with an external wall of the triangular frame; the triangular frame of the odd-numbered layers is fixed with the composite wooden poles 6 of the even-numbered layers at cross nodes by the third connectors.

The second pole orthogonal stacked wooden rib structures 21 comprise three layers of composite wooden pole units, wherein odd-numbered layer of the composite wooden pole units comprises three composite wooden poles 6 disposed in parallel, and even-numbered layer of the composite wooden pole units comprises six composite wooden poles 6 disposed in parallel; a size of the composite wooden poles 6 is 45×45×4000 mm; the composite wooden poles 6 of one layer of the composite wooden pole units are perpendicular to the composite wooden poles 6 of an adjacent layer of the composite wooden pole units; the composite wooden poles 6 of odd-numbered layers correspond to each other from top to bottom; the composite wooden poles 6 are fixed with each other at cross nodes by third connectors 7; the composite wooden pole units of the odd-numbered layers are provided with a rectangular frame, and the rectangular frame comprises four frame composite wooden poles 6 joined end to end; ends of the composite wooden poles 6 of the composite wooden pole units of the odd-numbered layers are all in contact with an internal wall of the rectangular frame of a corresponding layer; ends of the composite wooden poles 6 of the composite wooden pole units of the even-numbered layer are all flush with an external wall of the rectangular frame; the rectangular frame of the odd-numbered layers is fixed with the composite wooden poles 6 of the even-numbered layers at cross nodes by the third connectors.

The third pole orthogonal stacked wooden rib structures 22 comprise three layers of composite wooden pole units, wherein odd-numbered layer of the composite wooden pole units comprises four composite wooden poles 6 disposed in parallel, and even-numbered layer of the composite wooden pole units comprises five composite wooden poles 6 disposed in parallel; a size of the composite wooden poles 6 is 45×45×4000 mm; the composite wooden poles 6 of one layer of the composite wooden pole units are perpendicular to the composite wooden poles 6 of an adjacent layer of the composite wooden pole units; the composite wooden poles 6 of odd-numbered layers correspond to each other from top to bottom; the composite wooden poles 6 are fixed with each other at cross nodes by third connectors 7; the composite wooden pole units of the odd-numbered layers are provided with a triangular frame, and the triangular frame comprises three frame composite wooden poles 6 joined end to end; ends of the composite wooden poles 6 of the composite wooden pole units of the odd-numbered layers are all in contact with an internal wall of the triangular frame of a corresponding layer; ends of the composite wooden poles 6 of the composite wooden pole units of the even-numbered layer are all flush with an external wall of the triangular frame; the triangular frame of the odd-numbered layers is fixed with the composite wooden poles 6 of the even-numbered layers at cross nodes by the third connectors.

Each side frame of the cuboid frame 31 comprises four composite wooden poles 6, and a size of the composite wooden poles 6 is 45×45×4000 mm; the four composite wooden poles are integrated by parallel stacking and bolting.

Each side frame of the rectangle frames 32 comprises four composite wooden poles, and a size of the composite wooden poles 6 is 45×45×4000 mm; the four composite wooden poles are integrated by parallel stacking and bolting.

Each of the composite wooden poles 6 comprises three layers of wooden boards 61, and a size of the wooden board is 45×15×4000 mm; adjacent layers of the wooden boards 61 are bonded and fixed to each other.

The wooden boards 61 of the composite wooden poles 6 of a bottom layer of the composite wooden pole units of the first pole orthogonally stacked wooden rib structures 11 are arranged vertically; the wooden boards 61 of the composite wooden poles 6 of a bottom layer of the composite wooden pole units of the second pole orthogonally stacked wooden rib structures 21 are arranged vertically; and the wooden boards 61 of the composite wooden poles 6 of a bottom layer of the composite wooden pole units of the third pole orthogonally stacked wooden rib structures 22 are arranged vertically. Each of the composite wooden poles 6 has a square cross-section.

Each of the third connectors 7 comprises a nut 71, a spacer 72, an upper steel sheet 73, a lower steel sheet 74 and a screw 75 with a diameter of 10 mm; wherein through holes are drilled on the upper steel sheet 73, the lower steel sheet 74, and cross nodes of the orthogonally stacked composite wooden poles 6, which are adapted to the diameter of the screw; a size of the upper steel sheet 73 and the lower steel sheet 74 is 45×45×5 mm; the screw 75 passes through the spacer 72, the upper steel sheet 73, the orthogonally stacked composite wooden poles 6, and the lower steel sheet 74 from top to bottom; a portion of the screw 75, which is above the spacer 72, is screwed with the nut 71, and the nut 71 presses against the spacer 72; a bottom end of the screw 75 is welded to the lower steel sheet 74, and the lower steel sheet 74 presses against an adjacent composite wooden pole 6; excess portions of the screw 75 should be processed and cut off according to actual needs.

The first connector 4 is a V-shaped steel; internal top edges of the second pole orthogonally stacked wooden rib structures 21 press against internal bottom edges of the corresponding first pole orthogonally stacked wooden rib structure 11; a space, which has a triangular cross-section, is formed by the top portion of each of the second pole orthogonally stacked wooden rib structures 21 and the bottom portion of the corresponding first pole orthogonally stacked wooden rib structure 11, and the V-shaped steel is placed in the space; one side of the V-shaped steel matches with the top portions of the second pole orthogonally stacked wooden rib structures 21 and is bolted thereto by a bolt 8; the other side of the V-shaped steel matches with the bottom portion of the corresponding first pole orthogonally stacked wooden rib structure 11 and is bolted thereto by a bolt 8.

The second connector 5 is a steel angle; an internal edge of the internal top portion of the cuboid frame 31 presses against internal edges of the bottom portions of the second pole orthogonally stacked wooden rib structures 21; a space is formed between the internal top portion of the cuboid frame 31 and the bottom portions of the second pole orthogonally stacked wooden rib structures 21, and the steel angle is placed in the space; one side of the steel angle matches with the internal top portion of the cuboid frame 31 and is bolted thereto by a bolt 8; the other side of the steel angle presses against external edges of the bottom portions of the second pole orthogonally stacked wooden rib structures 21;

internal edges of the top portions of the rectangular frames 32 press against the internal edges of the bottom portions of the third pole orthogonally stacked wooden rib structures 22; a space is formed between the top portions of the rectangular frames 32 and the bottom portions of the third pole orthogonally stacked wooden rib structures 22, and the steel angle is placed in the space; one side of the steel angle matches with the top portions of the rectangular frames 32 and is bolted thereto; the other side of the steel angle presses against the external edges of the bottom portions of the third pole orthogonally stacked wooden rib structures 22.

Embodiment 2

A construction method of the pole yurt framing structure system of the embodiment 1 comprises steps of:

(1) prefabricating composite wooden poles; (2) assembling unit structures; (3) assembling the lattice wall; (4) installing the roof pole; and (5) installing the crown wheel; wherein.

the step (1) comprises specific steps of: prefabricating the composite wooden poles in a factory by gluing three layers of 45×15×4000 mm wooden boards 61 together to form one 45×45×4000 mm composite wooden pole 6;

the step (2) comprises specific steps of: assembling the first pole orthogonal stacked wooden rib structures 11, the second pole orthogonal stacked wooden rib structures 21, the third pole orthogonal stacked wooden rib structures 22, the cuboid frame 31, and the rectangular frames 32 at a construction site with the prefabricated composite wooden poles 6;

the step (3) comprises specific steps of: assembling the lattice wall 3 with the cuboid frame 31 and the rectangular frames 32 obtained in the step (2);

the step (4) comprises specific steps of: installing the second pole orthogonal stacked wooden rib structures 21 and the third pole orthogonal stacked wooden rib structures 22 obtained in the step (2) on a top of the lattice wall 3 obtained in step (3) to complete roof pole 2 assembly; and the step (5) comprises specific steps of: installing the first pole orthogonally stacked wooden rib structures 11 obtained in the step (2) on a top of the roof pole 2 obtained in the step (4) to complete crown wheel 1 assembly, thereby finishing the pole yurt framing structure system.

Figure 9:
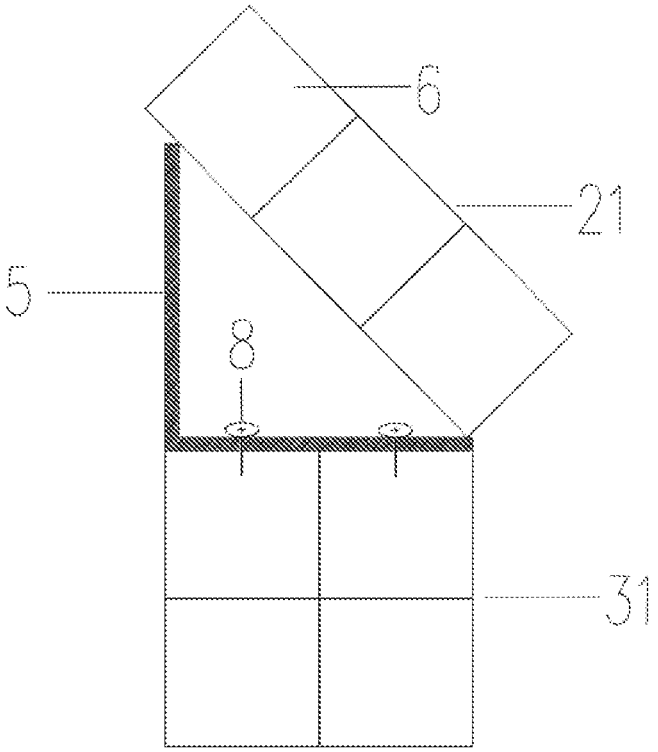
FIG. 9 is a sketch view of a second connector.
Figure 10:
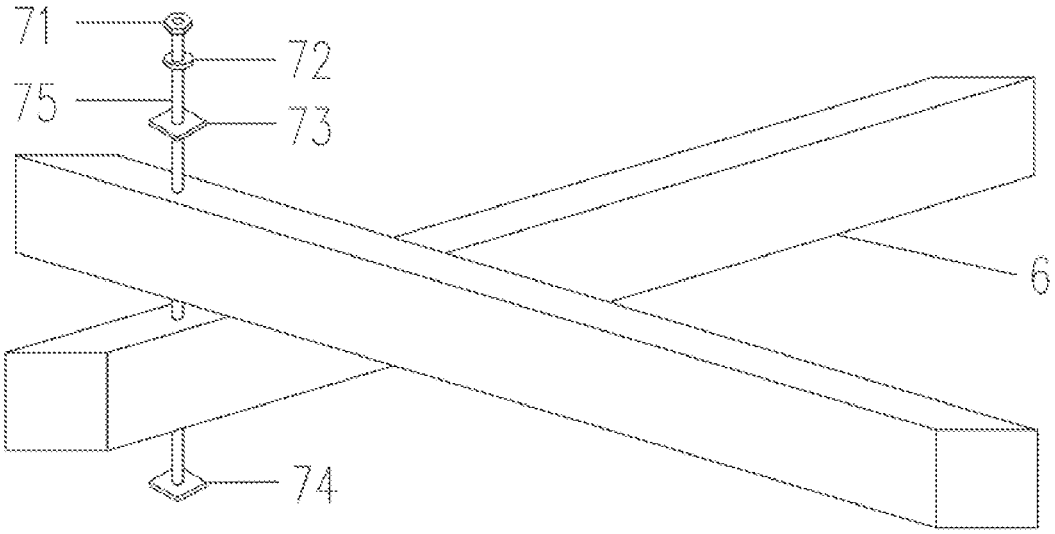
FIG. 10 is a sketch view of a third connector.
Figure 11:
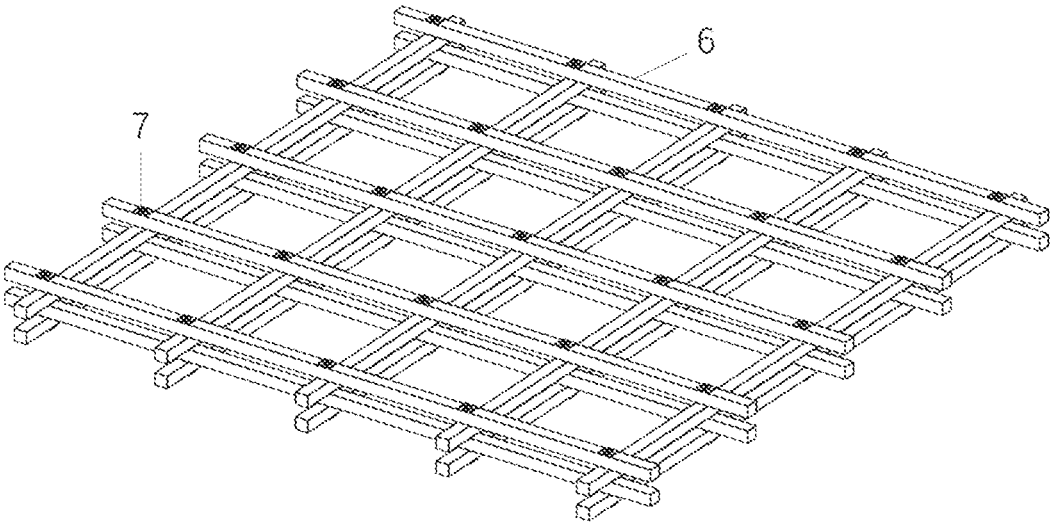
FIG. 11 is a perspective view of a pole orthogonal stacked wooden rib structure according to an embodiment 3.

Embodiment 3: Load capacity test of pole orthogonal stacked wooden rib structure (FIG. 9).

Test method: assembling a pole orthogonally stacked wooden rib structure (four layers, 4000 mm in length and width) with 45×45×4000 mm composite wooden pole; placing a medium density fiberboard (15×1220×2440 mm, 8.4 kg per square meter) above the pole orthogonally stacked wooden rib structure; placing bricks (2.2 kg each) on the medium density fiberboard as loads, wherein each hollow area of the pole orthogonally stacked wooden rib structure (49 locations) was right below four bricks; sampling nine points on the pole orthogonally stacked wooden rib structure and measuring bending degrees one hour after the loads were added; after measuring, adding bricks on top of the original bricks to continue the load test; and averaging the experimental results.

The measurement results are listed in the table below:

TABLE 1 load capacity of pole orthogonally stacked wooden rib structure (n = 9)

| | | Load value | | Average height difference | |
|---|---|---|---|---|---|
| Loading times | Number of bricks (blocks) | Total load (kg) | Load per square meter (kg) | Height difference (mm) | Cumulative height difference (mm) |
| Initial value | 0 | 134.4 | 8.40 | 0.00 | 0.00 |
| 1 time | 196 | 565.6 | 35.35 | −3.33 | −3.33 |
| 2 times | 392 | 996.8 | 62.30 | −3.89 | −7.22 |
| 3 times | 588 | 1428.0 | 89.25 | −3.83 | −11.06 |
| 4 times | 686 | 1643.6 | 102.73 | −1.78 | −12.83 |
| 5 times | 784 | 1859.2 | 116.20 | −2.44 | −15.28 |
| 6 times | 882 | 2074.8 | 129.68 | −2.61 | −17.89 |
| 7 times | 980 | 2290.4 | 143.15 | −2.33 | −20.22 |
| 8 times | 1078 | 2506.0 | 156.63 | −2.67 | −22.89 |
| 9 times | 1176 | 2721.6 | 170.10 | −3.00 | −25.89 |
| 10 times | 1274 | 2937.2 | 183.58 | −4.56 | −30.44 |
| 11 times | 1372 | 3152.8 | 197.05 | −3.56 | −34.00 |
| 12 times | 1470 | 3368.4 | 210.53 | −4.33 | −38.33 |
| 13 times | 1568 | 3584.0 | 224.00 | −4.78 | −43.11 |
| 14 times | 1666 | 3799.6 | 237.48 | −4.00 | −47.11 |
| 15 times | 1764 | 4015.2 | 250.95 | −5.11 | −52.22 |
| 16 times | 1862 | 4230.8 | 264.43 | −4.67 | −56.89 |
| 17 times | 1960 | 4446.4 | 277.90 | −5.00 | −61.89 |
| 18 times | 2058 | 4662.0 | 291.38 | −4.22 | −66.11 |
| 19 times | 2156 | 4877.6 | 304.85 | −4.56 | −70.67 |
| 20 times | 2254 | 5093.2 | 318.33 | −4.56 | −75.22 |
| 21 times | 2352 | 5308.8 | 331.80 | −4.78 | −80.00 |
| 22 times | 2450 | 5524.4 | 345.28 | −4.22 | −84.22 |
| 23 times | 2548 | 5740.0 | 358.75 | −4.78 | −89.00 |
| 24 times | 2646 | 5955.6 | 372.23 | −4.67 | −93.67 |
| 25 times | 2842 | 6386.8 | 399.18 | −7.89 | −101.56 |
| 26 times | 3038 | 6818.0 | 426.13 | −8.89 | −110.44 |

The load value refers to a total weight of the medium density fiberboard board and the bricks above the pole orthogonally stacked wooden rib structure; the height difference is a change in height of the pole orthogonally stacked wooden rib structure before and after increasing the load; and the cumulative height difference is a change in height of the pole orthogonally stacked wooden rib structure between an initial state (no bricks) and a loaded state.

As can be seen from Table 1, when the total load value is around 1000 kg, the height of the pole orthogonally stacked wooden rib structure of the present invention is lowered by about 7 mm; and when the total load value is about 4000 kg, the height of the pole orthogonally stacked wooden rib structure of the present invention is lowered by about 50 mm. The total load value of the 18th test was 4662 kg, and the pole orthogonally stacked wooden rib structure started to squeak. Therefore, the pole orthogonally stacked wooden rib structures provided by the present invention has high bearing capacity, which are fixed by the third connectors. The pole yurt framing structure system obtained is stable in overall structural strength, low in cost, safe and eco-friendly, which is suitable for the grassland environment.

The foregoing is only preferred embodiments of the present invention, which is not intended to be limiting. Any modifications, equivalent substitutions and improvements made within the spirit and principles of the present invention shall be included in the protection scope of the present invention.

What is claimed is:

1. A pole yurt framing structure system, comprising: a crown wheel, a roof pole, and a lattice wall; wherein the crown wheel is a prismatic conical structure formed by multiple triangular first pole orthogonally stacked wooden rib structures; each side of the first pole orthogonally stacked wooden rib structures is fixed with a side of an adjacent first pole orthogonally stacked wooden rib structure;

the roof pole comprises multiple rectangular second pole orthogonally stacked wooden rib structures and multiple triangular third pole orthogonally stacked wooden rib structures; wherein quantities of the second pole orthogonally stacked wooden rib structures, the third pole orthogonally stacked wooden rib structures, and the first pole orthogonally stacked wooden rib structures are identical; a top portion of each of the second pole orthogonally stacked wooden rib structures is fixed with a bottom portion of a corresponding first pole orthogonally stacked wooden rib structure by a first connector; two adjacent second pole orthogonally stacked wooden rib structures are spaced by one of the third pole orthogonally stacked wooden rib structures, and each side of the third pole orthogonally stacked wooden rib structures is fixed with a side of an adjacent second pole orthogonally stacked wooden rib structure;

the lattice wall comprises at least one cuboid frame and multiple rectangular frames; wherein a total quantity of the cuboid frame and the rectangular frames is equal to a total quantity of the second pole orthogonally stacked wooden rib structures and the third pole orthogonally stacked wooden rib structures; an internal top portion of the cuboid frame is fixed with bottom portions of the second pole orthogonally stacked wooden rib structures by a second connector; two sides of the cuboid frame are provided with the rectangular frames, and the rectangular frames are fixed with an adjacent internal side of the cuboid frame; the rest of the rectangular frames are fixed with adjacent rectangular frames in sequence; top portions of the rectangular frames are fixed with the bottom portions of the second pole orthogonally stacked wooden rib structures or bottom portions of the third pole orthogonally stacked wooden rib structures by the second connector.

2. The pole yurt framing structure system, as recited in claim 1, wherein the first pole orthogonal stacked wooden rib structures comprise at least two layers of composite wooden pole units, and each layer of the composite wooden pole units comprises multiple composite wooden poles disposed in parallel; the composite wooden poles of one layer of the composite wooden pole units are perpendicular to the composite wooden poles of an adjacent layer of the composite wooden pole units; when the first pole orthogonally stacked wooden rib structures comprise three or more layers of the composite wooden pole units, the composite wooden poles of odd-numbered layers correspond to each other from top to bottom and the composite wooden poles of even-numbered layers correspond to each other from top to bottom; the composite wooden poles are fixed with each other at cross nodes by third connectors; the composite wooden pole units of the odd-numbered layers are provided with a triangular frame, and the triangular frame comprises three frame composite wooden poles joined end to end; ends of the composite wooden poles of the composite wooden pole units of the odd-numbered layers are all in contact with an internal wall of the triangular frame of a corresponding layer; ends of the composite wooden poles of the composite wooden pole units of the even-numbered layer are all flush with an external wall of the triangular frame; the triangular frame of the odd-numbered layers is fixed with the composite wooden poles of the even-numbered layers at cross nodes by the third connectors.

3. The pole yurt framing structure system, as recited in claim 2, wherein each of the composite wooden poles comprises at least two layers of wooden boards, and adjacent layers of the wooden boards are bonded and fixed to each other.

4. The pole yurt framing structure system, as recited in claim 3, wherein the wooden boards of the composite wooden poles of a bottom layer of the composite wooden pole units of the first pole orthogonally stacked wooden rib structures are arranged vertically.

5. The pole yurt framing structure system, as recited in claim 3, wherein each of the composite wooden poles has a square cross-section.

6. The pole yurt framing structure system, as recited in claim 2, wherein each of the third connectors comprises a nut, a spacer, an upper steel sheet, a lower steel sheet and a screw; wherein through holes are drilled on the upper steel sheet, the lower steel sheet, and cross nodes of the orthogonally stacked composite wooden poles, which are adapted to the diameter of the screw; the screw passes through the spacer, the upper steel sheet, the orthogonally stacked composite wooden poles, and the lower steel sheet from top to bottom; a portion of the screw, which is above the spacer, is screwed with the nut, and the nut presses against the spacer; a bottom end of the screw is welded to the lower steel sheet, and the lower steel sheet presses against an adjacent composite wooden pole.

7. The pole yurt framing structure system, as recited in claim 1, wherein the second pole orthogonal stacked wooden rib structures comprise at least two layers of composite wooden pole units, and each layer of the composite wooden pole units comprises multiple composite wooden poles disposed in parallel; the composite wooden poles of one layer of the composite wooden pole units are perpendicular to the composite wooden poles of an adjacent layer of the composite wooden pole units; when the second pole orthogonally stacked wooden rib structures comprise three or more layers of the composite wooden pole units, the composite wooden poles of odd-numbered layers correspond to each other from top to bottom and the composite wooden poles of even-numbered layers correspond to each other from top to bottom; the composite wooden poles are fixed with each other at cross nodes by third connectors; the composite wooden pole units of the odd-numbered layers are provided with a rectangular frame, and the rectangular frame comprises four frame composite wooden poles joined end to end; ends of the composite wooden poles of the composite wooden pole units of the odd-numbered layers are all in contact with an internal wall of the rectangular frame of a corresponding layer; ends of the composite wooden poles of the composite wooden pole units of the even-numbered layer are all flush with an external wall of the rectangular frame; the rectangular frame of the odd-numbered layers is fixed with the composite wooden poles of the even-numbered layers at cross nodes by the third connectors.

8. The pole yurt framing structure system, as recited in claim 7, wherein each of the composite wooden poles comprises at least two layers of wooden boards, and adjacent layers of the wooden boards are bonded and fixed to each other.

9. The pole yurt framing structure system, as recited in claim 8, wherein the wooden boards of the composite wooden poles of a bottom layer of the composite wooden pole units of the second pole orthogonally stacked wooden rib structures are arranged vertically.

10. The pole yurt framing structure system, as recited in claim 7, wherein each of the third connectors comprises a nut, a spacer, an upper steel sheet, a lower steel sheet and a screw; wherein through holes are drilled on the upper steel sheet, the lower steel sheet, and cross nodes of the orthogonally stacked composite wooden poles, which are adapted to the diameter of the screw; the screw passes through the spacer, the upper steel sheet, the orthogonally stacked composite wooden poles, and the lower steel sheet from top to bottom; a portion of the screw, which is above the spacer, is screwed with the nut, and the nut presses against the spacer; a bottom end of the screw is welded to the lower steel sheet, and the lower steel sheet presses against an adjacent composite wooden pole.

11. The pole yurt framing structure system, as recited in claim 1, wherein the third pole orthogonal stacked wooden rib structures comprise at least two layers of composite wooden pole units, and each layer of the composite wooden pole units comprises multiple composite wooden poles disposed in parallel; the composite wooden poles of one layer of the composite wooden pole units are perpendicular to the composite wooden poles of an adjacent layer of the composite wooden pole units; when the third pole orthogonally stacked wooden rib structures comprise three or more layers of the composite wooden pole units, the composite wooden poles of odd-numbered layers correspond to each other from top to bottom and the composite wooden poles of even-numbered layers correspond to each other from top to bottom; the composite wooden poles are fixed with each other at cross nodes by third connectors; the composite wooden pole units of the odd-numbered layers are provided with a triangular frame, and the triangular frame comprises three frame composite wooden poles joined end to end; ends of the composite wooden poles of the composite wooden pole units of the odd-numbered layers are all in contact with an internal wall of the triangular frame of a corresponding layer; ends of the composite wooden poles of the composite wooden pole units of the even-numbered layer are all flush with an external wall of the triangular frame; the triangular frame of the odd-numbered layers is fixed with the composite wooden poles of the even-numbered layers at cross nodes by the third connectors.

12. The pole yurt framing structure system, as recited in claim 11, wherein each of the composite wooden poles comprises at least two layers of wooden boards, and adjacent layers of the wooden boards are bonded and fixed to each other.

13. The pole yurt framing structure system, as recited in claim 12, wherein the wooden boards of the composite wooden poles of a bottom layer of the composite wooden pole units of the third pole orthogonally stacked wooden rib structures are arranged vertically.

14. The pole yurt framing structure system, as recited in claim 11, wherein each of the third connectors comprises a nut, a spacer, an upper steel sheet, a lower steel sheet and a screw; wherein through holes are drilled on the upper steel sheet, the lower steel sheet, and cross nodes of the orthogonally stacked composite wooden poles, which are adapted to the diameter of the screw; the screw passes through the spacer, the upper steel sheet, the orthogonally stacked composite wooden poles, and the lower steel sheet from top to bottom; a portion of the screw, which is above the spacer, is screwed with the nut, and the nut presses against the spacer; a bottom end of the screw is welded to the lower steel sheet, and the lower steel sheet presses against an adjacent composite wooden pole.

15. The pole yurt framing structure system, as recited in claim 1, wherein each side frame of the cuboid frame comprises multiple composite wooden poles, and the composite wooden poles are integrated by parallel stacking.

16. The pole yurt framing structure system, as recited in claim 1, wherein each side frame of the rectangle frames comprises multiple composite wooden poles, and the composite wooden poles are integrated by parallel stacking.

17. The pole yurt framing structure system, as recited in claim 1, wherein the first connector is a V-shaped steel; internal top edges of the second pole orthogonally stacked wooden rib structures press against internal bottom edges of the corresponding first pole orthogonally stacked wooden rib structure; a space, which has a triangular cross-section, is formed by the top portion of each of the second pole orthogonally stacked wooden rib structures and the bottom portion of the corresponding first pole orthogonally stacked wooden rib structure, and the V-shaped steel is placed in the space; one side of the V-shaped steel matches with the top portions of the second pole orthogonally stacked wooden rib structures and is bolted thereto; the other side of the V-shaped steel matches with the bottom portion of the corresponding first pole orthogonally stacked wooden rib structure and is bolted thereto.

18. The pole yurt framing structure system, as recited in claim 1, wherein the second connector is a steel angle; an internal edge of the internal top portion of the cuboid frame presses against internal edges of the bottom portions of the second pole orthogonally stacked wooden rib structures; a space is formed between the internal top portion of the cuboid frame and the bottom portions of the second pole orthogonally stacked wooden rib structures, and the steel angle is placed in the space; one side of the steel angle matches with the internal top portion of the cuboid frame and is bolted thereto; the other side of the steel angle presses against external edges of the bottom portions of the second pole orthogonally stacked wooden rib structures, or against external edges of the bottom portions of the third pole orthogonally stacked wooden rib structures;

internal edges of the top portions of the rectangular frames press against the internal edges of the bottom portions of the second pole orthogonally stacked wooden rib structures, or against internal edges of the bottom portions of the third pole orthogonally stacked wooden rib structures; a space is formed between the top portions of the rectangular frames and the bottom portions of the second pole orthogonally stacked wooden rib structures or the bottom portions of the third pole orthogonally stacked wooden rib structures, and the steel angle is placed in the space; one side of the steel angle matches with the top portions of the rectangular frames and is bolted thereto; the other side of the steel angle presses against the external edges of the bottom portions of the second pole orthogonally stacked wooden rib structures, or against the external edges of the bottom portions of the third pole orthogonally stacked wooden rib structures.

19. A construction method of the pole yurt framing structure system as recited in claim 1, comprising steps of: (1) prefabricating composite wooden poles; (2) assembling unit structures; (3) assembling the lattice wall; (4) installing the roof pole; and (5) installing the crown wheel; wherein the step (1) comprises specific steps of: prefabricating the composite wooden poles in a factory by gluing at least two layers of wooden boards together to form one composite wooden pole;

the step (2) comprises specific steps of: assembling the first pole orthogonal stacked wooden rib structures, the second pole orthogonal stacked wooden rib structures, the third pole orthogonal stacked wooden rib structures, the cuboid frame, and the rectangular frames at a construction site with the prefabricated composite wooden poles;

the step (3) comprises specific steps of: assembling the lattice wall with the cuboid frame and the rectangular frames obtained in the step (2);

the step (4) comprises specific steps of: installing the second pole orthogonal stacked wooden rib structures and the third pole orthogonal stacked wooden rib structures obtained in the step (2) on a top of the lattice wall obtained in step (3) to complete roof pole assembly; and the step (5) comprises specific steps of: installing the first pole orthogonally stacked wooden rib structures obtained in the step (2) on a top of the roof pole obtained in the step (4) to complete crown wheel assembly, thereby finishing the pole yurt framing structure system.

* * * * *